US006273411B1

(12) United States Patent
Vijuk

(10) Patent No.: US 6,273,411 B1
(45) Date of Patent: Aug. 14, 2001

(54) BOOKLET FORMING METHOD AND APPARATUS

(75) Inventor: Joseph M. Vijuk, Oakbrook, IL (US)

(73) Assignee: Vijuk Equipment, Inc., Elmhurst, IL (US)

( * ) Notice: Subject to any disclaimer, the term of this patent is extended or adjusted under 35 U.S.C. 154(b) by 0 days.

(21) Appl. No.: 09/326,821

(22) Filed: Jun. 7, 1999

(51) Int. Cl.[7] ..... B42C 9/00

(52) U.S. Cl. ..... 270/37; 270/58.07; 493/383; 493/405; 493/417; 83/934

(58) Field of Search ..... 270/37, 58.07; 493/405, 417, 262, 383, 384, 385, 415; 83/934

(56) References Cited

U.S. PATENT DOCUMENTS

| | | | |
|---|---|---|---|
| Re. 30,958 | 6/1982 | White | 40/310 |
| 1,239,965 | 9/1917 | Reinhold . | |
| 1,273,105 | 7/1918 | Van Dyke et al. . | |
| 1,326,859 | 12/1919 | Grammar . | |
| 1,853,829 | 4/1932 | Maury . | |
| 1,974,401 | 9/1934 | Miller | 40/4 |
| 2,706,865 | 4/1955 | Miller | 40/2 |

(List continued on next page.)

FOREIGN PATENT DOCUMENTS

| | | | |
|---|---|---|---|
| 10939 | 9/1880 | (DE) | 281/5 |
| 3125369A * | 5/1982 | (DE) . | |
| 19818160A * | 10/1999 | (DE) . | |
| 744196 | 4/1933 | (FR) | 281/5 |
| 1403865 | 5/1965 | (FR) | 281/5 |
| 28013 | 12/1907 | (GB) | 283/34 |
| 20385 | 10/1914 | (GB) | 283/34 |
| 1429868A * | 3/1976 | (GB) . | |
| 2221190A * | 1/1990 | (GB) . | |

*Primary Examiner*—Christopher P. Ellis
*Assistant Examiner*—Patrick Mackey
(74) *Attorney, Agent, or Firm*—Marshall, O'Toole, Gerstein, Murray & Borun

(57) ABSTRACT

A method and apparatus for folding a single sheet of paper into a booklet. The method includes depositing adhesive along a linear path on the single sheet of paper and folding the sheet by making a plurality of folds parallel to a first direction, thereby forming a plurality of interconnected panels. The lateral edges of the panels are cut off so that the panels are no longer interconnected. A fold is made along a line coincident with the linear path to form the booklet. The booklet may be further folded with close folds to obtain a compact outsert. Apparatus for performing the folding patterns is also provided.

7 Claims, 19 Drawing Sheets

U.S. PATENT DOCUMENTS

| | | | | |
|---|---|---|---|---|
| 2,751,222 | | 6/1956 | Dexter | 270/81 |
| 2,862,624 | | 12/1958 | Stokes | 210/493 |
| 3,760,520 | | 9/1973 | Hamilton | 40/102 |
| 3,773,314 | | 11/1973 | Giovannini | 270/63 |
| 3,994,118 | | 11/1976 | Felix | 53/124 D |
| 4,010,299 | | 3/1977 | Hershey, Jr. et al. | 428/44 |
| 4,046,366 | * | 9/1977 | McCain et al. | 270/37 |
| 4,097,067 | | 6/1978 | Schechter | 283/56 |
| 4,229,926 | | 10/1980 | Rowling | 53/429 |
| 4,270,742 | | 6/1981 | Kobayashi | 270/37 |
| 4,279,409 | * | 7/1981 | Pemberton | 270/37 X |
| 4,331,327 | | 5/1982 | Felix | 271/9 |
| 4,441,739 | | 4/1984 | Cluff et al. | 281/16 |
| 4,529,229 | | 7/1985 | Glibbery | 283/81 |
| 4,583,763 | | 4/1986 | Shacklett, Jr. | 281/5 |
| 4,606,553 | | 8/1986 | Nickerson | 281/5 |
| 4,616,815 | | 10/1986 | Vijuk | 270/45 |
| 4,621,837 | | 11/1986 | Mack | 283/105 |
| 4,637,633 | | 1/1987 | Instance | 283/81 |
| 4,660,856 | | 4/1987 | Shacklett, Jr. | 281/5 |
| 4,685,993 | | 8/1987 | Flaherty et al. | 156/475 |
| 4,708,368 | | 11/1987 | Instance | 283/81 |
| 4,812,195 | | 3/1989 | Vijuk | 156/357 |
| 4,817,931 | | 4/1989 | Vijuk | 270/37 |
| 4,830,406 | | 5/1989 | Instance | 283/81 |
| 4,850,611 | | 7/1989 | Skelton | 251/5 |
| 4,853,063 | | 8/1989 | Basgil et al. | 156/238 |
| 4,868,027 | | 9/1989 | Hunkeler et al. | 428/42 |
| 4,887,373 | | 12/1989 | Macaulay | 40/119 |
| 4,905,977 | | 3/1990 | Vijuk | 270/45 |
| 4,906,024 | | 3/1990 | Lein | 283/34 X |
| 4,991,878 | | 2/1991 | Cowan et al. | 283/81 |
| 4,997,205 | | 3/1991 | Hansch | 281/2 |
| 5,044,873 | | 9/1991 | Vijuk | 414/712.5 |
| 5,046,710 | | 9/1991 | Vijuk | 270/37 |
| 5,074,595 | | 12/1991 | Hill et al. | 283/81 |
| 5,156,898 | | 10/1992 | McDonald | 428/130 X |
| 5,200,243 | | 4/1993 | Van Veen | 428/40 |
| 5,207,746 | | 5/1993 | Jones | 283/81 |
| 5,234,231 | | 8/1993 | Hollander et al. | 281/2 |
| 5,254,189 | | 10/1993 | Hirobe et al. | 156/64 |
| 5,351,991 | | 10/1994 | McDonald | 281/2 |
| 5,403,636 | | 4/1995 | Crum | 428/40 |
| 5,439,721 | | 8/1995 | Pedroli et al. | 428/40 |
| 5,458,374 | | 10/1995 | Vijuk et al. | 283/81 |
| 5,480,370 | | 1/1996 | Gelsinger | 493/475 |
| 5,547,175 | * | 8/1996 | Graushar et al. | 270/37 |
| 5,593,749 | | 1/1997 | Instance | 428/40.1 |
| 5,599,410 | | 2/1997 | Reinders | 156/64 |
| 5,605,730 | | 2/1997 | Treleaven | 428/40.1 |
| 5,639,332 | | 6/1997 | Instance | 156/248 |
| 5,655,866 | * | 8/1997 | Bellanca | 412/1 |
| 5,667,210 | | 9/1997 | DeLise, Jr. | 270/37 |
| 5,685,530 | | 11/1997 | DeLise | 270/37 |
| 5,813,700 | | 9/1998 | Vijuk et al. | 283/81 |
| 5,909,899 | | 6/1999 | Vijuk et al. | 283/81 |
| 6,029,968 | * | 2/2000 | Honegger | 270/37 |
| 6,068,300 | | 5/2000 | Vijuk et al. | 283/67 |

* cited by examiner

FIG. 1
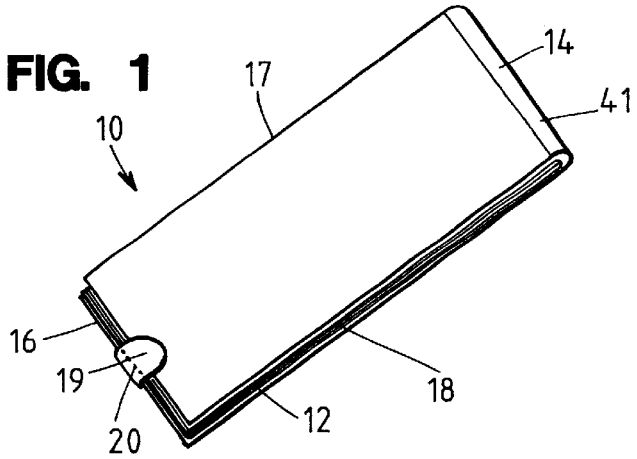
FIG. 2A
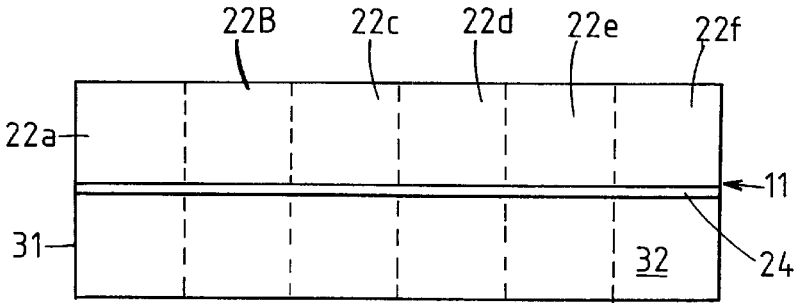
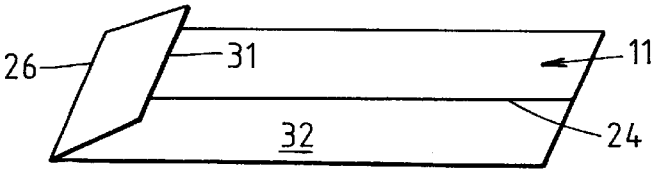
FIG. 2B
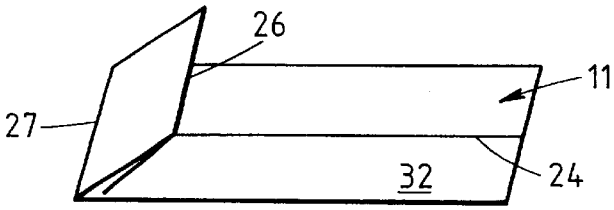
FIG. 2C
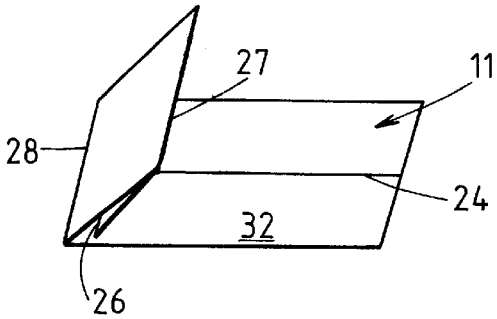
FIG. 2D

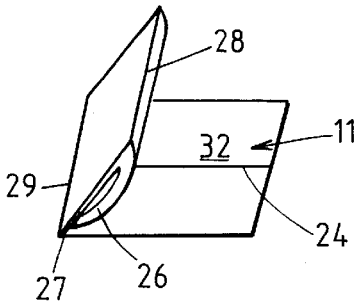
FIG. 2E
FIG. 2F
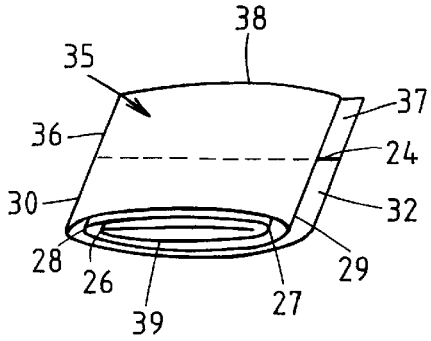
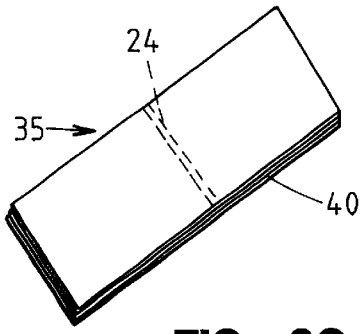
FIG. 2G
FIG. 3A
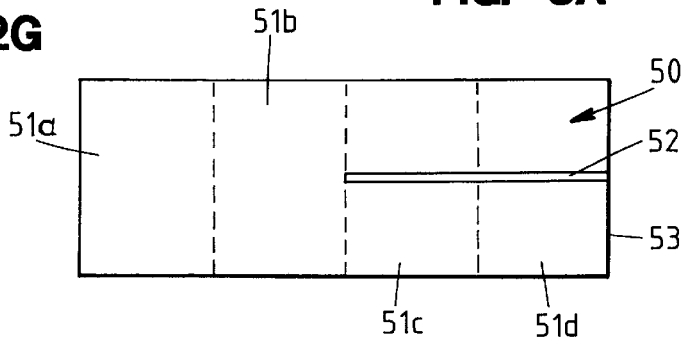
FIG. 3B
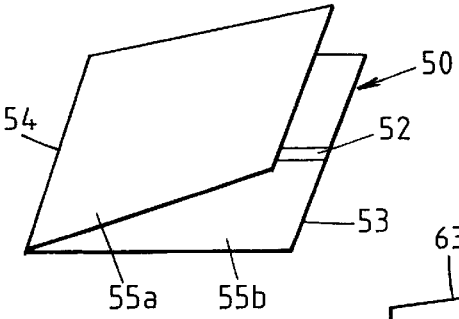
FIG. 3C
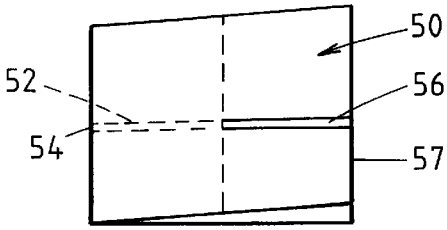
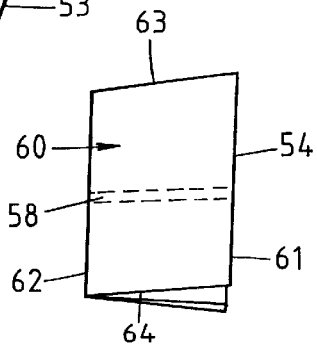
FIG. 3D FIG. 4A
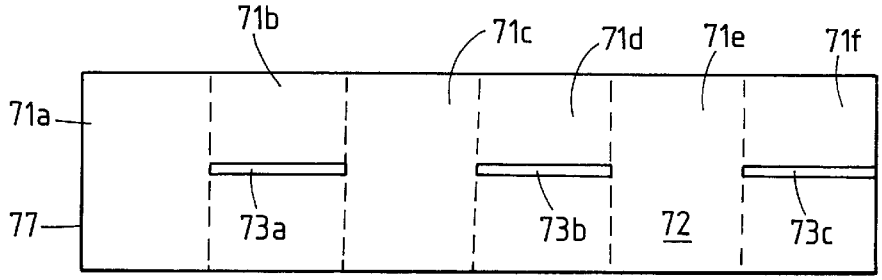
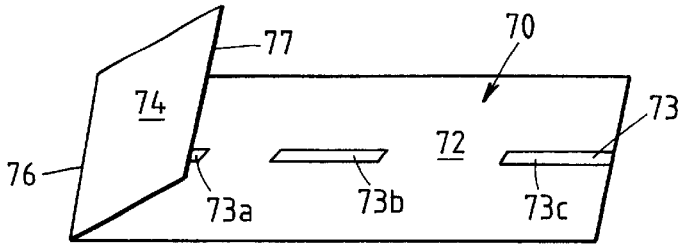
FIG. 4B
FIG. 4C
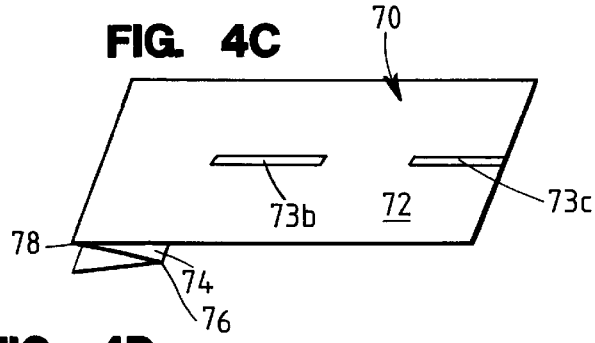
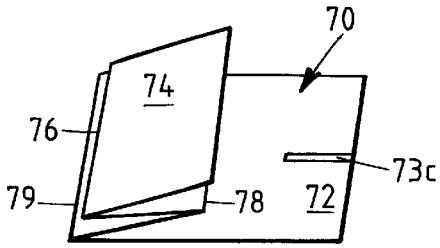
FIG. 4D
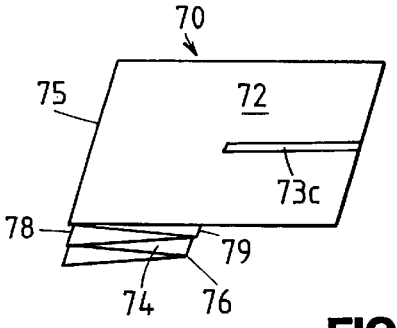
FIG. 4E
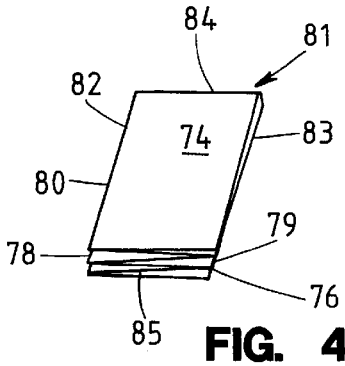
FIG. 4F

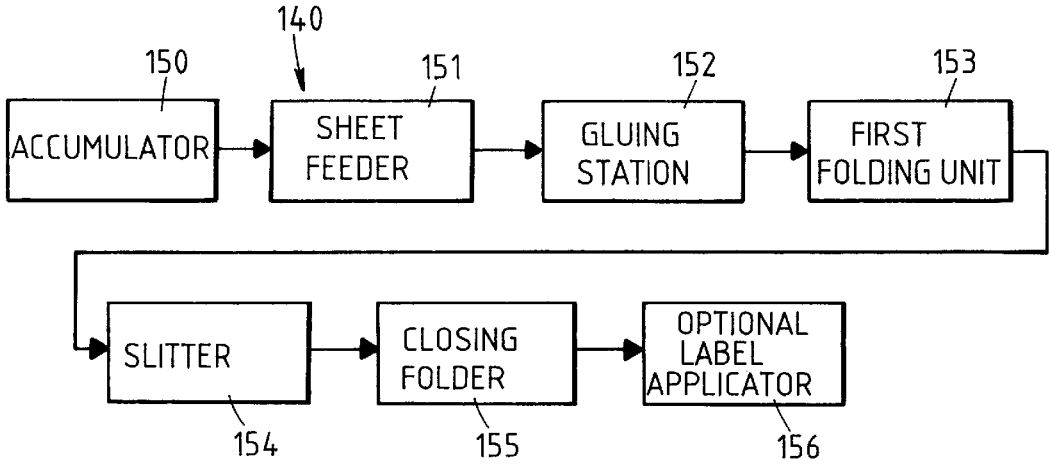
FIG. 7
FIG. 8
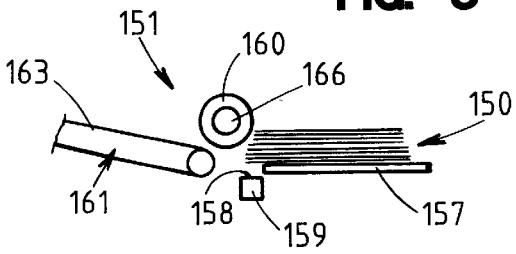
FIG. 11
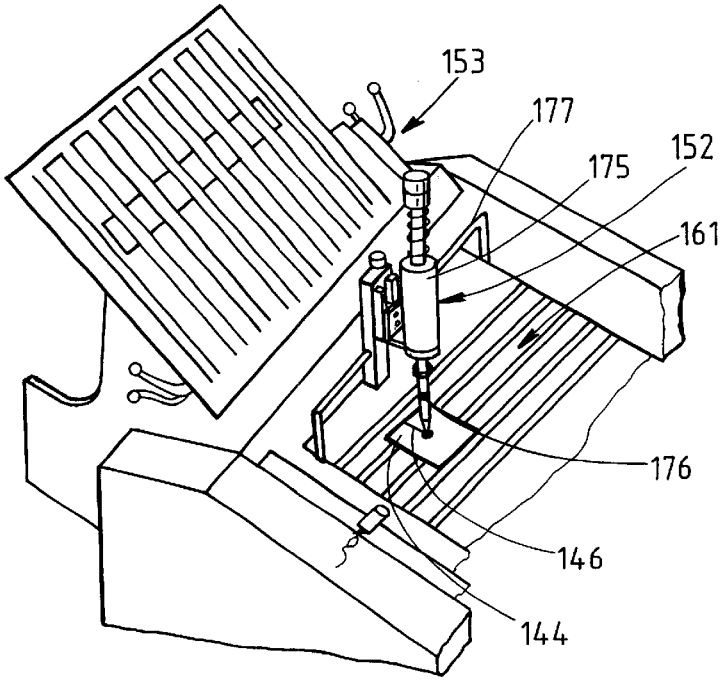

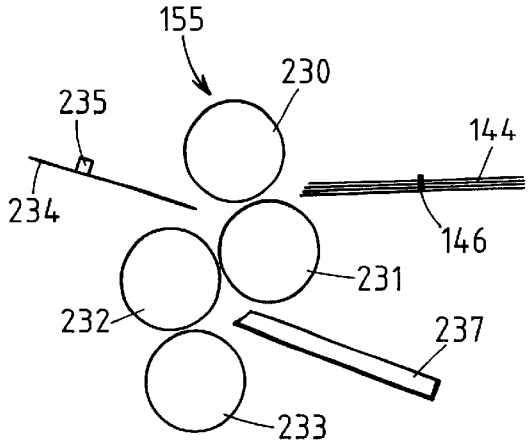
FIG. 16A
FIG. 16B
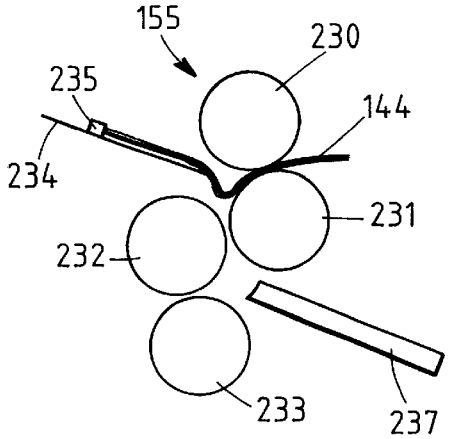
FIG. 16C
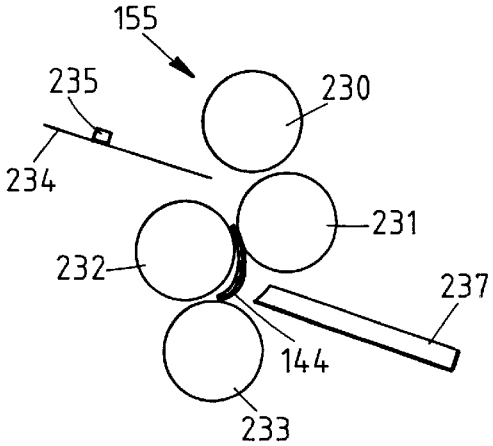
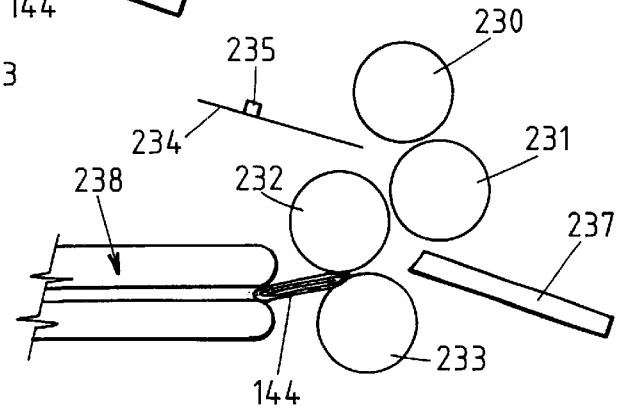
FIG. 16D

BOOKLET FORMING METHOD AND APPARATUS

FIELD OF THE INVENTION

The present invention relates to methods and apparatus for folding leaflets, and more particularly relates to methods and apparatus for folding outserts in a booklet form.

BACKGROUND OF THE INVENTION

Folded leaflets are used to provide information regarding a wide variety of products. In particular, pharmaceutical products are often packaged with folded leaflets called outserts, which provide printed information, instructions, and warnings to users of the product. Outserts are typically made by folding a single printed sheet into a small packet for insertion into the pharmaceutical packaging during the packaging process. The sheet is typically folded in two perpendicular directions to obtain a compact outsert. Larger printed sheets, however, are cumbersome to use and are often visually unattractive.

Leaflets provided in booklet form are known which may present a more visually appearing outsert. For example, U.S. Pat. No. 5,685,530 to DeLise discloses a folded booklet and method for making the same in which two or more different printed sheets are bound together to form a booklet. Binding the different printed sheets to form the booklet of DeLise, however, requires complex machinery capable of handling different printed sheets from multiple sheet sources.

SUMMARY OF THE INVENTION

According to one aspect of the present invention, a method of forming a booklet from a single sheet of paper is provided in which the booklet has a bound side, an unbound side parallel to the bound side, and two unbound sides perpendicular to the bound side. The method comprises the steps of first applying an adhesive to the single sheet of paper along a linear path so that the adhesive makes contact with a plurality of rectangular sheet portions of the single sheet of paper. Next the single sheet of paper is folded by making a plurality of folds in the sheet of paper parallel to a first direction to form a plurality of sheet panels, each of the sheet panels corresponding to one of the rectangular sheet portions. Each of the sheet panels is connected to at least one adjacent sheet panel and is separated from at least one adjacent sheet panel by one of the folds parallel to the first direction. Each of the sheet panels is further adhered to at least another of the sheet panels by the adhesive so that all of the sheet panels are adhered together to form an intermediate product having a first side, a second side, a third side, and a fourth side, the first and second sides being parallel to each other and parallel to the first direction. A plurality of cuts are made in the intermediate product so that the first side and the second side of the intermediate product are cut off and so that the sheet panels are no longer interconnected at the folds made in the first direction. The intermediate product is folded by malting a final fold in the intermediate product along a line coincident with the linear path along which the adhesive was applied to form the booklet. The booklet so formed has a bound side coincident with the final fold, an unbound side spaced from the bound side and parallel to the final fold, and two unbound sides spaced from each other and perpendicular to the final fold.

In accordance with another aspect of the invention, a method of forming a closed booklet from a single sheet of paper is provided in which the booklet has a bound side, an unbound side parallel to the bound side, and two unbound sides perpendicular to the bound side. The method comprises the steps of applying an adhesive to the single sheet of paper along a linear path so that the adhesive makes contact with a plurality of rectangular sheet portions of the single sheet of paper. The single sheet of paper is folded by making a plurality of folds in the sheet of paper parallel to a first direction to form a plurality of sheet panels, each of the sheet panels corresponding to one of the rectangular sheet portions and is connected to at least one adjacent sheet panel. Each of the sheet panels is further separated from at least one adjacent sheet panel by one of the folds parallel to the first direction and is adhered to at least another of the sheet panels by the adhesive so that all of the sheet panels are adhered together to form an intermediate product having a first side, a second side, a third side, and a fourth side, the first and second sides being parallel to each other and parallel to the first direction. A plurality of cuts are made in the intermediate product so that the first side and the second side of the intermediate product are cut off and so that the sheet panels are no longer interconnected at the folds made in the first direction. The intermediate product is folded by making a final fold in the intermediate product along a line coincident with the linear path along which the adhesive was applied to form the booklet, the booklet so formed having a bound side coincident with the final fold, an unbound side spaced from the bound side and parallel to the final fold, and two unbound sides spaced from each other and perpendicular to the final fold. The booklet is folded by making a first closing fold in the booklet parallel to the linear path along which the adhesive was applied, the first closing fold being made so that the unbound side of the booklet parallel to the final fold is disposed between the bound side of the booklet and the first closing fold to form a partially closed booklet. The partially closed booklet so formed has a first portion between the first closing fold and the bound side of the booklet and a second portion between the first closing fold and the unbound side of the booklet. The partially closed booklet is folded by making a second closing fold in the first portion of the partially closed booklet parallel to the linear path along which the adhesive was applied, the second closing fold being made so that the first portion covers the unbound side of the booklet.

In accordance with still further aspects of the present invention, apparatus for folding a single sheet of paper into a booklet is provided in which the booklet has a bound side, an unbound side parallel to the bound side, and two unbound sides perpendicular to the bound side. The apparatus comprises an adhesive applicator that deposits adhesive along a linear path so that the adhesive makes contact with a plurality of rectangular sheet portions of the single sheet of paper. A first folding unit has a plurality of cylindrical folding roller pairs positioned to grip and pull buckled portions of the sheet and form a plurality of folds in the sheet of paper parallel to a first direction. The plurality of folds defines a plurality of sheet panels, each of the sheet panels corresponding to one of the rectangular sheet portions. The folding rollers of each pair are spaced to adhere the sheet panels together with the adhesive to form an intermediate product having a first side, a second side, a third side, and a fourth side, the first and second sides being parallel to each other and parallel to the first direction. A slitter has blades positioned to cut off the first and second sides of the intermediate product so that the sheet panels are no longer interconnected at the folds made in the first direction. A second folding unit has a pair of cylindrical folding rollers positioned to grip the intermediate product along a line coincident with the linear path along which the adhesive was applied to form a final fold and form the booklet. The booklet has a bound side coincident with the final fold, an unbound side spaced from the bound side and parallel to the final fold, and two unbound sides spaced from each other and perpendicular to the final fold.

In accordance with still further aspects of the present invention, apparatus for folding a single sheet of paper into a booklet is provided, in which the booklet has a bound side, an unbound side parallel to the bound side, and two unbound sides perpendicular to the bound side, the apparatus comprising. An adhesive applicator deposits adhesive along a linear path so that the adhesive makes contact with a plurality of rectangular sheet portions of the single sheet of paper. A first folding unit has a plurality of cylindrical folding roller pairs positioned to grip and pull buckled portions of the sheet to form a plurality of folds in the sheet of paper parallel to a first direction to form a plurality of sheet panels, each of the sheet panels corresponding to one of the rectangular sheet portions. The folding rollers of each pair are spaced to adhere the sheet panels together with the adhesive to form an intermediate product having a first side, a second side, a third side, and a fourth side, the first and second sides being parallel to each other and parallel to the first direction. A slitter has blades positioned to cut off the first and second sides of the intermediate product so that the sheet panels are no longer interconnected at the folds made in the first direction. A second folding unit has a pair of cylindrical folding rollers positioned to grip the intermediate product along a line coincident with the linear path along which the adhesive was applied to form a final fold and form the booklet, the booklet having a bound side coincident with the final fold, an unbound side spaced from the bound side and parallel to the final fold, and two unbound sides spaced from each other and perpendicular to the final fold. A first pair of closing rollers is positioned to form a first closing fold in the booklet parallel to the linear path along which the adhesive was applied, the first closing fold being made so that the unbound side of the booklet parallel to the final fold is disposed between the bound side of the booklet and the first closing fold to form a partially closed booklet. The partially closed booklet has a first portion between the first closing fold and the bound side of the booklet, and a second portion between the first closing fold and the unbound side of the booklet parallel to the final fold. A second pair of closing rollers is positioned to form a second closing fold in the booklet parallel to the linear path along which the adhesive was applied, the second closing fold being made in the first portion of the partially closed booklet so that the first portion of the partially closed booklet covers the unbound side of the booklet parallel to the final fold.

Other features and advantages are inherent in the apparatus claimed and disclosed or will become apparent to those skilled in the art from the following detailed description and its accompanying drawings.

BRIEF DESCRIPTION OF THE DRAWINGS

FIG. 1 is a perspective view of a booklet formed in accordance with certain aspects of the present invention.

FIGS. 2A through 2G illustrate a folding pattern for obtaining the booklet illustrated in FIG. 1.

FIGS. 3A through 3D illustrate an alternative folding pattern for obtaining the booklet illustrated in FIG. 1.

FIGS. 4A through 4F illustrate yet another alternative folding pattern for obtaining the booklet illustrated in FIG. 1.

FIG. 7 is a block diagram of booklet folding apparatus for forming the booklet illustrated in FIG. 1.

FIG. 8 is a diagrammatic side view illustrating portions of an accumulator and a sheet feeder used in the booklet folding apparatus.

FIG. 11 is a partially schematic plan view of a gluing station and first folding unit used in the booklet folding apparatus.

FIGS. 16A through 16D illustrate folding steps carried out by a closing folder used in the booklet folding apparatus.

DETAILED DESCRIPTION OF THE PREFERRED EMBODIMENT

Figure 5:
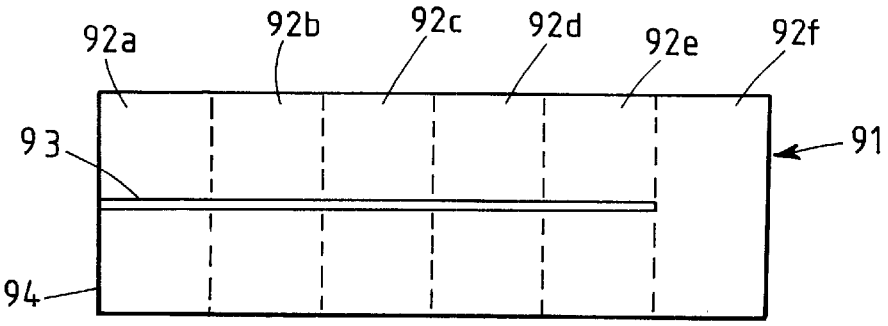
FIG. 5 is a plan view of a single sheet of paper having an alternative adhesive strip for forming a removable booklet page.

A booklet 10 formed from a single sheet of paper in accordance with the present invention is illustrated in FIG. 1. The steps used to form the booklet 10 are diagrammatically illustrated in FIGS. 2A through 2G. Referring to FIG. 2A, a single sheet of paper II is shown having six rectangular sheet portions 22*a–f* illustrated with phantom lines. Adhesive is applied to a first face 32 of the sheet 11 along a linear path 24, which may be continuous or discontinuous, such as a dotted glue line. The linear path 24 extends across the entire length of the sheet 11, so that the adhesive contacts a plurality of the rectangular sheet portions 22*a–f* (FIG. 2A).

A first fold 26 is formed in the sheet of paper 11 parallel to a first direction which, in this embodiment, is perpendicular to the linear path 24 (FIG. 2B). The first fold 26 is formed by folding a leading edge portion of the sheet 11, which at this time is adjacent to a front edge 31 of the sheet 11, towards the first face 32 of the sheet 11, as illustrated in FIG. 2B. A second fold 27 is then formed in the sheet 11, as illustrated in FIG. 2C, also by folding a leading edge portion of the sheet 11, now adjacent to the first fold 26, towards the first face 32 of the sheet 11. This same process is used to form third, fourth, and fifth folds 28, 29, 30 parallel to the first direction, as illustrated in FIGS. 2D, 2E, and 2F. Each of the folds 28–30 is made by folding a leading edge portion, which is adjacent to the most recent fold, toward the first face 32, so that the sheet 11 is formed into a flat roll 34 (FIG. 2F).

After the fifth fold 30, the sheet of paper 11 has a thickness of six plies, and the folds divide the sheet into six sheet panels joined at the folds. Each of the panels corresponds to a rectangular sheet portion 22*a–f,* and is adhered to at least one of the other sheet panels by the adhesive. As a result, all of the sheet panels are adhered together to form an intermediate product 35 having a first side 36, a second side 37, a third side 38, and a fourth side 39, as best illustrated in FIG. 2F.

The first and second sides 36, 37 of the intermediate product 35 are then cut off so that the sheet panels are no longer interconnected at the folds, as illustrated in FIG. 2G. At this point, the single sheet of paper 11 has been converted into a plurality of strips 40 adhered together by the adhesive. A final fold 41 is formed in the strips 40 along a line coincident with the linear path 24 along which the adhesive was applied to form the booklet 10 (FIG. 1). The booklet 10 includes a plurality of pages 12 connected at a bound side 14. An unbound side 16 is parallel to the bound side 14, and two lateral unbound sides 17, 18 are perpendicular to the bound side 14. According to the illustrated embodiment, the unbound side 16 is secured with an adhesive-backed closure member 19 having perforations 20 to facilitate opening of the booklet 10.

An alternative folding pattern for forming the booklet 10 is illustrated in FIGS. 3A through 3D. As illustrated in FIG. 3A, a single sheet of paper 50 is divided into four rectangular sheet portions 51*a–d.* Adhesive is applied along a first linear path 52 extending from a midpoint of the sheet 50 to a trailing edge 53 of the sheet (FIG. 3A). A first fold 54 is formed parallel to a first direction so that first and second half panels 55*a–b* are superimposed and adhered together by the adhesive applied along the first linear path 52 (FIG. 3B). Adhesive is then applied along a second linear path 56 extending from a midpoint of the folded sheet 50 to a trailing edge 57 of the sheet, as shown in FIG. 3C. A second fold 58 is formed parallel to the first direction so that four quarter panels 59*a–d* are superimposed and adhered together by the adhesive (FIG. 3D), the four quarter panels 59*a–d* corresponding to the four rectangular sheet portions 51*a–d* illustrated in FIG. 3A. After the second fold 58, the sheet of paper has a thickness of four plies. The adhered panels form an intermediate product 60 having a first side 61, a second side 62, a third side 63, and a fourth side 64, as best illustrated in FIG. 3D. The first and second sides 61, 62 are then cut off and the adhered panels are folded along a line coincident with the first and second linear paths 52, 56 to form the booklet 10.

Yet another alternative folding pattern for forming the booklet 10 is illustrated in FIGS. 4A through 4F. A single sheet of paper 70 is divided into six rectangular sheet portions 71*a–f* (FIG. 4A). Adhesive is applied to first face 72 of the sheet 70 along a first linear path comprising three portions 73*a,* 73*b,* 73*c,* contacting rectangular sheet portions 71*b,* 71*d,* and 71*f,* respectively (FIG. 4A). Accordingly, it will be appreciated that the adhesive is applied in an alternating pattern which skips every other panel.

The sheet 70 with adhesive is folded with a first fold 76 parallel to a first direction (FIG. 4B). The first fold 76 is made by folding a leading edge portion, adjacent to a front edge 77 of the sheet 70, toward the first face 72 of the sheet 70 so that the first fold is parallel to a first direction perpendicular to the first and second linear paths 73, 75. Adhesive at the linear path portion 73*a* adheres together the first and second rectangular sheet portions 71*a,* 71*b.* A second fold 78 is formed in the sheet 70 by folding a leading edge portion, now adjacent to the first fold 76, toward a second face 74 of the sheet 70, the second fold 76 also being parallel to the first direction (FIG. 4C). No adhesive is present between the second and third sheet portions 71*b,* 71*c.* Third, fourth, and fifth folds 79, 80, and 75 (illustrated in FIGS. 4D, 4E, and 4F, respectively) are made in the sheet 70 to form six sheet panels corresponding to the six rectangular sheet portions 71*a–f.* The result is an intermediate product 81 having six sheet panels joined by accordion folds 76, 78, 79, 80, and 75. The intermediate product 81 has a first side 82, a second side 83, a third side 84, and a fourth side 85, as best illustrated in FIG. 4F. It will further be appreciated that the intermediate product 81, because of the skipping adhesive pattern, includes three pairs of adhered panels.

The first and second sides 82, 83 of the intermediate product 81 are cut off so that the sheet panels 81*a–e* are no longer interconnected at the folds. As a result, the three pairs of adhered panels are converted into three separate, stacked panel pairs. A final fold is formed in the intermediate product 81 along a line coincident with the first and second linear paths 73, 75 to form the booklet 10. In this embodiment, the booklet 10 includes three separate booklet portions which are removable. This embodiment is particularly suited for application in which distinct booklet portions are desired. For example, instructions may be provided in multiple languages, and therefore each language may be provided in a separate booklet portion.

The above patterns are provided as examples only, as it will be appreciated that a single sheet of paper may be folded in a number of different patterns to obtain a booklet having multiple panels. Each of these patterns include making a plurality of folds in the sheet parallel to a first direction to form a plurality of interconnected panels. The panels are superimposed, and lateral edges of the panels may be cut off so that the panels are no longer interconnected. The panels are then folded over to form a booklet.

The adhesive used to form the booklet 10 may be selectively applied so that a removable booklet page is formed. As best shown in FIG. 5, a single sheet of paper 91 has six rectangular sheet portions 92*a–f.* Adhesive is applied along a linear path 93 extending from a leading sheet edge 94 and across the first five sheet portions 92*a–e,* but skipping the trailing sheet portion 92*f.* As a result, when the sheet 91 is folded to form an intermediate product, such as a flat roll similar to that illustrated in FIG. 2F, the sheet panels formed will include a plurality of glued sheet panels corresponding to the rectangular sheet portions 92*a–e* receiving glue and an unglued sheet panel corresponding to the rectangular sheet portion 92*f* not receiving glue. Each glued sheet panel will adhere to at least one other glued sheet panel, while the unglued sheet panel will remain unadhered. When the edges of the intermediate product are cut and the intermediate product is folded into a booklet, the unglued sheet panel will form a removable page.

Figure 6A:
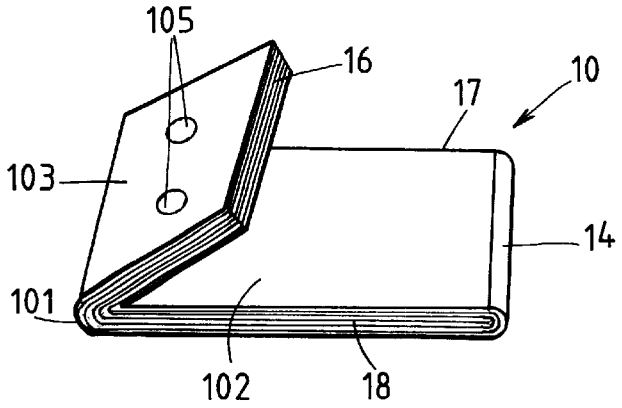
FIGS. 6A and 6B illustrate closing folds for closing the booklet illustrated in FIG. 1.

Additional folds may be formed in the booklet 10 so that a periphery of the booklet is free of unfolded edges, thereby adapting the booklet for high speed operations. As illustrated in FIG. 1, a booklet, such as booklet 10, has a bound side 14, an unbound side 16 parallel to the bound side 14, and two lateral unbound sides 17, 18. As described above, the bound side 14 corresponds to the final fold 41 which is coincident with the linear path 24 along which adhesive is applied. As illustrated in FIG. 6A, a first closing fold 101 is formed in the booklet along a line parallel to the linear path 24. The first closing fold 101 is formed nearer the unbound side 16 of the booklet 10, so that the unbound side 16 is disposed between the bound side 14 and the first closing fold 101 to form a partially closed booklet. The partially closed booklet has a first portion 102 extending between the first closing fold 101 and the bound side 14 and a second portion 103 extending between the first closing fold 101 and the unbound side 16.

Figure 6B:
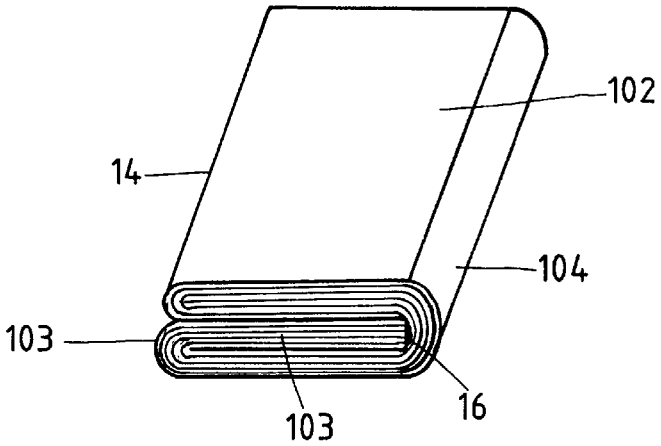

A second closing fold 104 is also formed in the booklet 10 to completely close the booklet, as illustrated in FIG. 6B. The second closing fold 104 is formed along a line parallel to the linear path 24 nearer the bound side 14, so that the first portion 102 of the booklet 10 covers the second portion 103. The folded booklet 10 provides a compact outsert in booklet form. The periphery of the closed outsert 10 is free of unfolded edges, thereby reducing the tendency of the outsert to jam during processing operations.

The folded booklet 10 may be secured to hold the booklet in the closed position. For example, drops of adhesive 105 may be applied to the second portion 103 of the booklet 10 between the forming of the first and second folds 101, 104 (FIG. 6A). When the second fold 104 is made, the adhesive drops 105 will hold the first portion 102 against the second portion 103, thereby holding the booklet 10 in the closed position. The adhesive drops 105 may alternatively be applied to the first portion 102.

An alternative closing fold pattern may be used in which the unbound side 16 is disposed at the periphery of the folded booklet 10. In this alternative, a first closing fold is formed parallel to the linear path 24 and nearer the bound side 14. A second closing fold, also parallel to the linear path 24, is formed nearer the unbound side 16. The resulting closed booklet has a compact size. The booklet may be held closed using adhesive drops or adhesive-backed closure members, as described above.

In accordance with additional aspects of the present invention, apparatus 140 is provided for folding a single sheet of paper 144 into a booklet. A block diagram of the booklet folding apparatus in which the present invention is incorporated is shown in FIG. 7. The apparatus generally comprises an accumulator 150, a sheet feeder 151, a gluing station 152, a first folding unit 153, a slitter 154, a closing folder 155, and an optional label applicator 156.

FIG. 8 illustrates a portion of the accumulator 150 shown schematically in FIG. 7. As shown in FIG. 8, the accumulator has a base plate 157 onto which a stack of sheets is deposited. Pressurized air is forced against the lower portion of the stack of sheets in a conventional manner to slightly raise the lowermost sheets, thereby reducing the coefficient of friction between the lowermost sheet in the stack and the base plate 157 and providing slight physical separation between the lowermost sheets in the stack. The pressurized air is provided by a number of apertures formed in the base plate 157 and a number of apertures 158 formed in a manifold 159.

Figure 9:
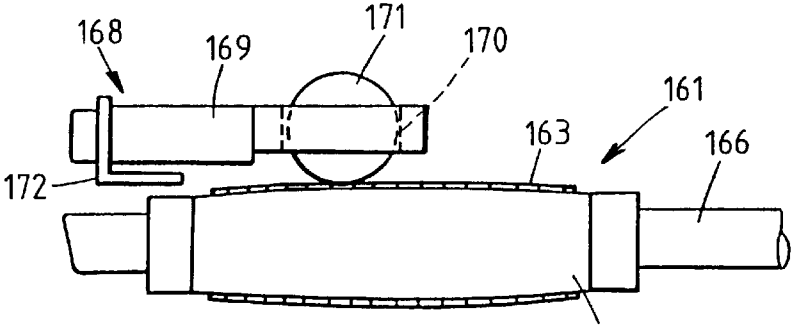
FIG. 9 is an end view of a sheet feeder used in the booklet forming apparatus.
Figure 10:
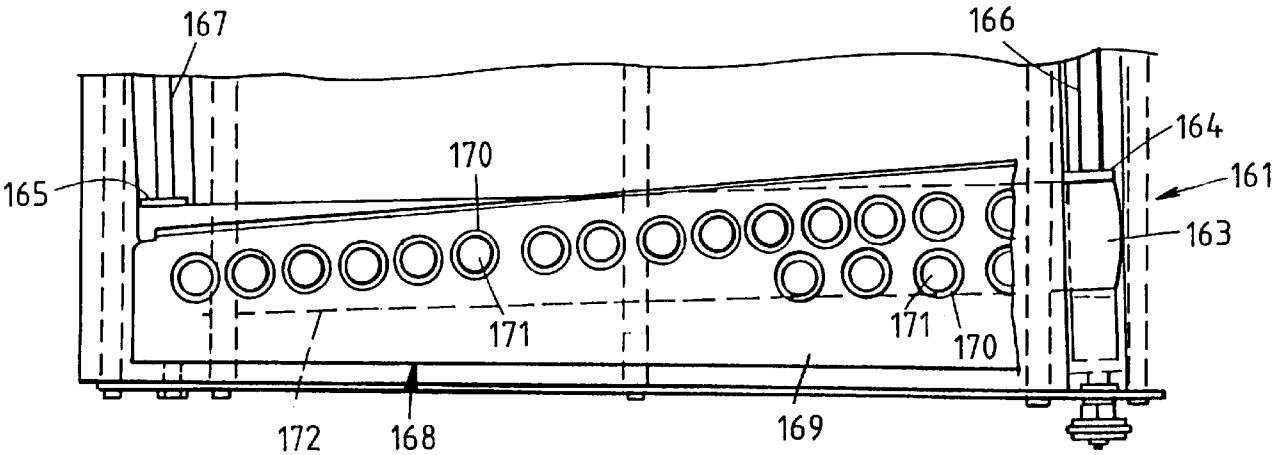
FIG. 10 is a plan view of the sheet feeder of FIG. 9.

FIGS. 8, 9, and 10 illustrate the sheet feeder 151 shown schematically in FIG. 7. Referring to FIG. 8, the sheet feeder 151 has a fist part in the form of a vacuum drum or roll 160 and a second part in the form of a conveyor 161. The vacuum roll 160, which is controlled to periodically remove the lowermost sheet from the bottom of the stack of sheets, is provided in the form of a hollow cylindrical drum having a plurality of holes formed in its cylindrical outer surface, and is positioned above the base plate 157. The vacuum roll 160 has a hollow interior portion 166 in which a reduced or suction pressure may be selectively provided. To that end, the interior of the vacuum roll 160 is pneumatically coupled to a vacuum pump (not shown).

FIGS. 9 and 10 illustrate the structure of the conveyor 161 shown schematically in FIG. 7. Referring to FIGS. 9 and 10, the conveyor 161 has a conveyor belt 163 driven by a pair of spaced rollers 164, 165, each of which is rotatably driven by a respective drive rod 166, 167. The conveyor 161 also includes a sheet alignment mechanism 168 positioned directly over the conveyor belt 163. The alignment mechanism 168 includes a retainer arm 169 having a plurality of cylindrical bores 170 formed therein, a respective metal ball 171 disposed within each of the bores 170, and an L-shaped side guide 172 connected to the retainer arm 169.

Sheets from the accumulator 150 are periodically and individually fed by the vacuum roll 162 to the conveyor 161 so that they pass between the bottom of the metal balls 171 and the top of the conveyor belt 163. The weight of the metal balls 171 resting on top of the sheets maintains the alignment of the sheets relative to the conveyor belt 163. As shown in FIG. 10, the side guide 172 is angled slightly relative to the conveyor belt 163. Consequently, as the sheets pass through the conveyor 161 (from right to left in FIG. 12), the side edges of the sheets are gradually moved against the edge of the side guide 172, which movement causes the side edges of the sheets to become justified or flush against the side guide 172 for proper alignment as the sheets pass the gluing station 152. The particular mechanical designs of the accumulator 150 and sheet feeder 151 described above are not considered important to the invention, and other designs could be used. Accumulators and sheet feeders of the type described above are commercially available from Vijuk Equipment Co. of Elmhurst, Ill.

FIG. 11 illustrates the gluing station 152 shown schematically in FIG. 7. The gluing station 152 comprises a power-operated adhesive applicator 175, such as a solenoid-operated gluing nozzle 176, which applies a line of adhesive to a passing sheet 144 of paper prior to any folding. The applicator 175 is slidably mounted on a horizontal support bar 177 above the conveyor 161. The nozzle 176 is positioned to dispense a strip of adhesive along a linear path 146 across the sheet 144. The applicator 175 is selectively operable to vary the length of the adhesive strip, as well as the type of strip (i.e., continuous or intermittent).

After passing the glue station 152, the sheet 144 is conveyed to the first folding unit 153. In the embodiment illustrated in FIG. 12, the first folding unit includes twelve folding rollers 180–191 positioned to form folds in the sheet parallel to a first direction. A leading edge 146 of the sheet 144 is fed between folding rollers 180, 181 which advance the sheet across a downstream folding plate 192 until the leading edge 146 engages a stop 193. The stop 193 forms a buckled portion 194 in the sheet 144, as illustrated in FIG. 13A. The buckled portion 194 is gripped between folding rollers 181, 182 to form a first fold 195 parallel to a first direction. At this time, it will be appreciated that the leading edge of the sheet 144 is now the first fold 195. A deflector 196 located downstream of the folding rollers 181, 182 directs the leading edge back through folding rollers 182, 183 (FIG. 13B) to advance the sheet across a second folding plate 192 until the leading edge 146 engages a second stop 193 (FIG. 13C). The second stop 198 forms a buckled portion 199 in the sheet 144, as illustrated in FIG. 13C. The buckled portion 199 is gripped between folding rollers 182, 183 to form a second fold 200 parallel to the first direction (FIG. 13D). The same process is repeated by the feeding rollers 183–190 to form third, fourth, and fifth folds 201, 202, 203 in the sheet 144, each fold forming the new leading edge of the sheet (FIGS. 13E–13K). Each folding roller is grooved and aligned with the linear path along which adhesive is applied so that the adhesive will not hit a folding roller or spread adhesive on the rollers. The final folding rollers 190, 191 advance the folded sheet to a pair of scoring rollers 204, 205 which have male and female blades that indent or otherwise crease or score the folded sheet with score lines corresponding to subsequent folds to be made in the sheet 144.

Figure 12:
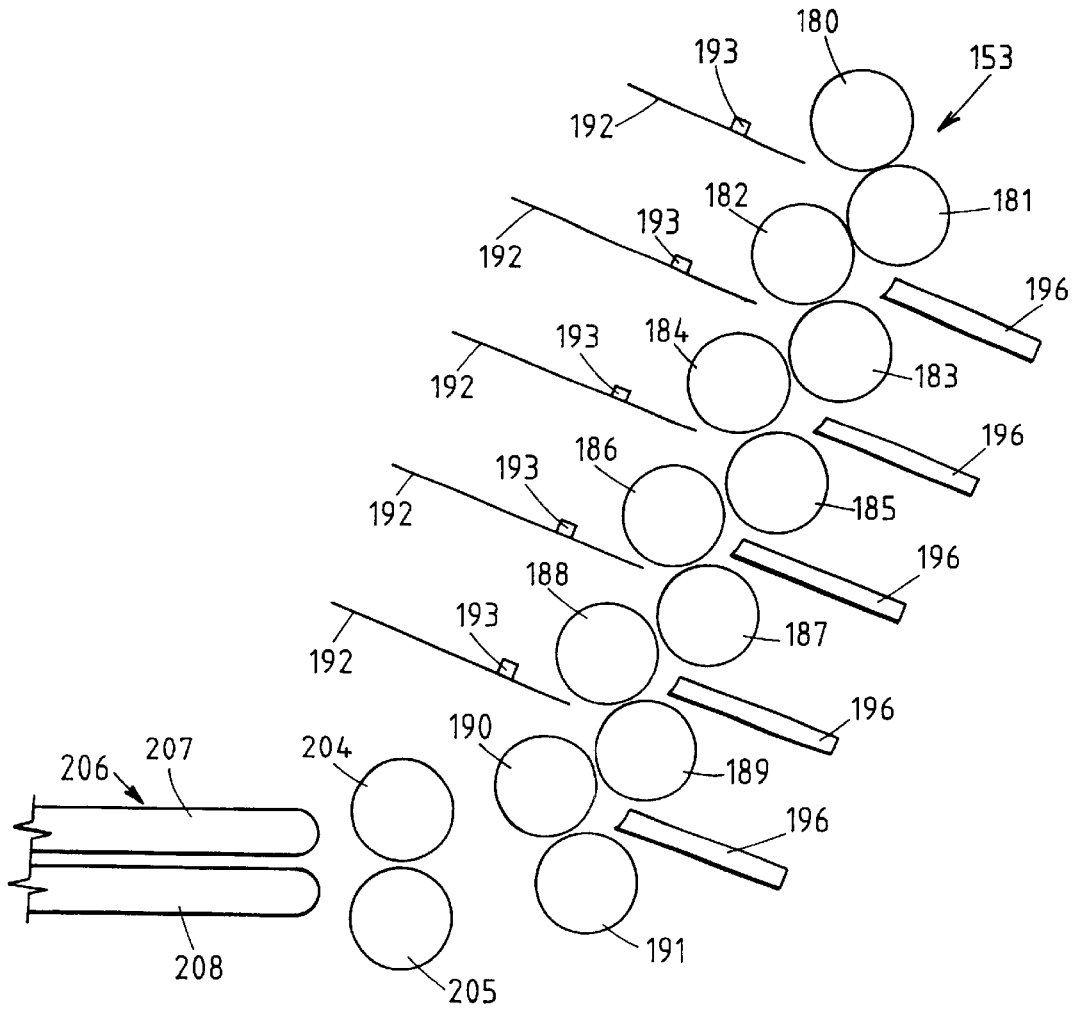
FIG. 12 is diagrammatic side view of a first folding unit used in the booklet forming apparatus.
Figure 13A:
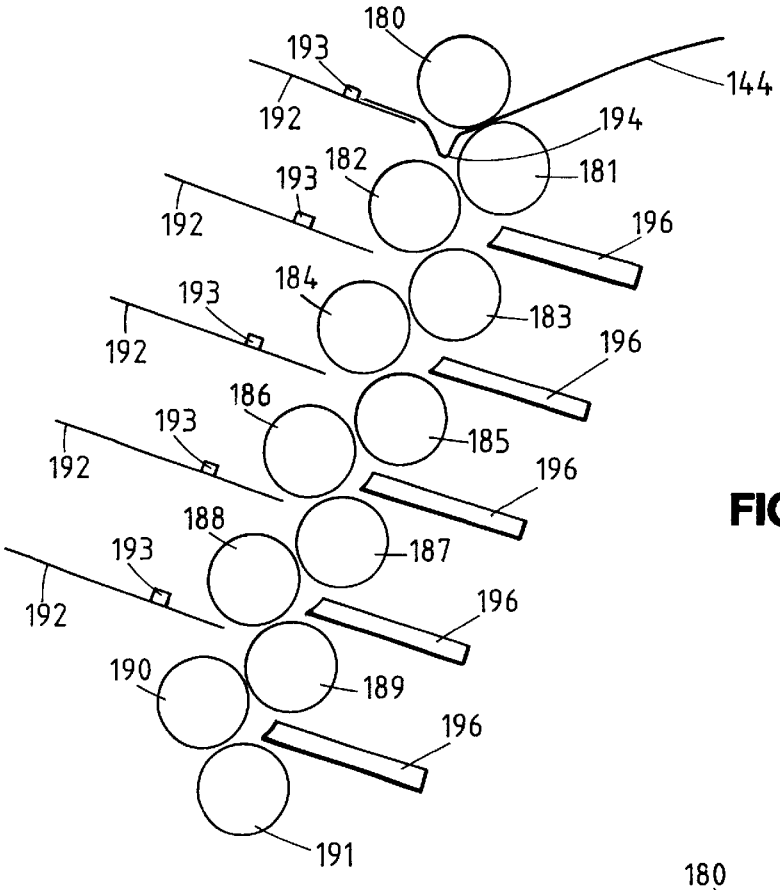
FIGS. 13A through 13K illustrate folding steps carried out by the first folding unit of FIG. 12.
Figure 13B:
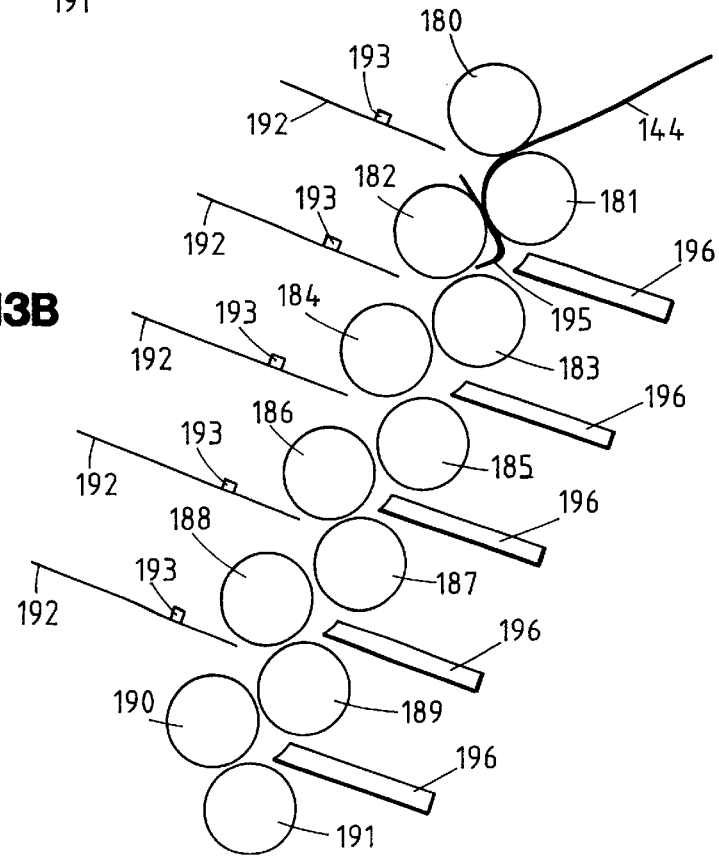
Figure 13C:
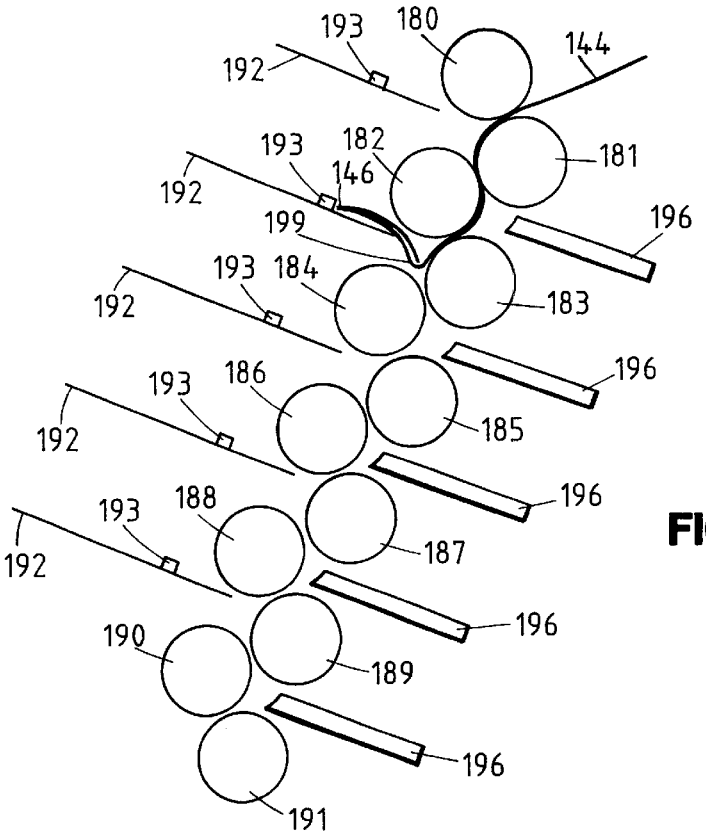
Figure 13D:
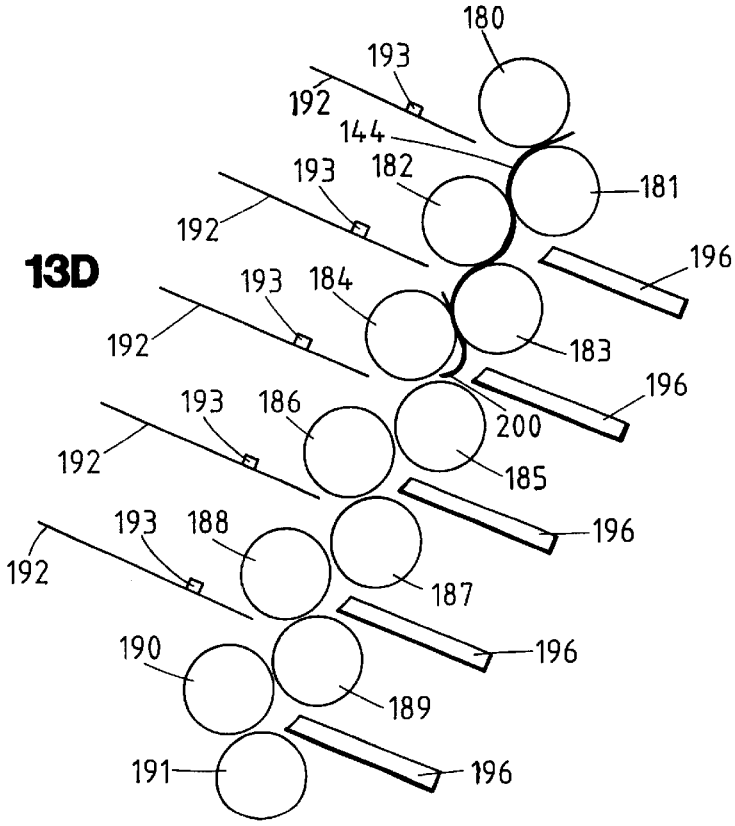
Figure 13E:
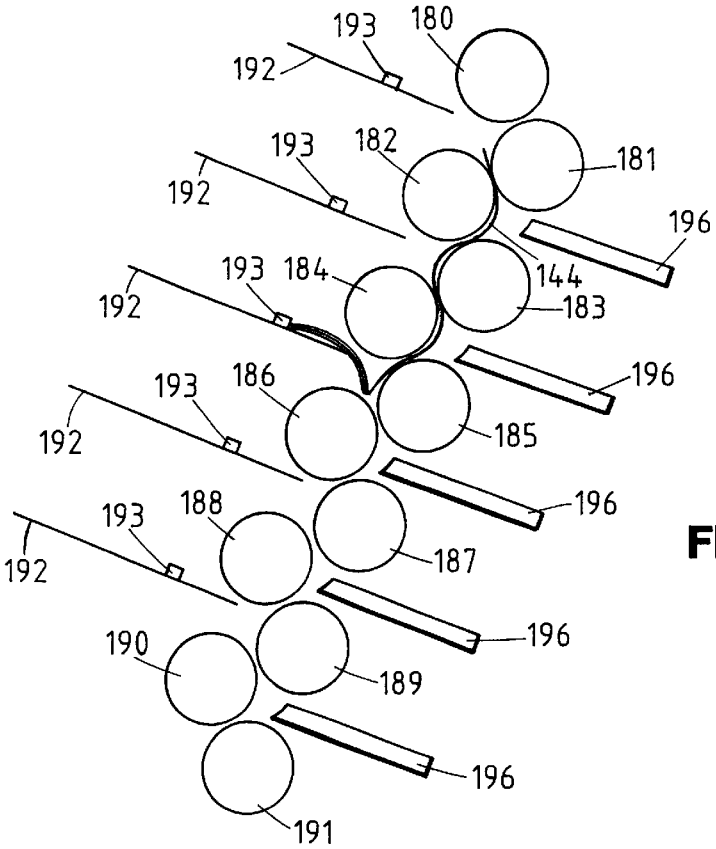
Figure 13F:
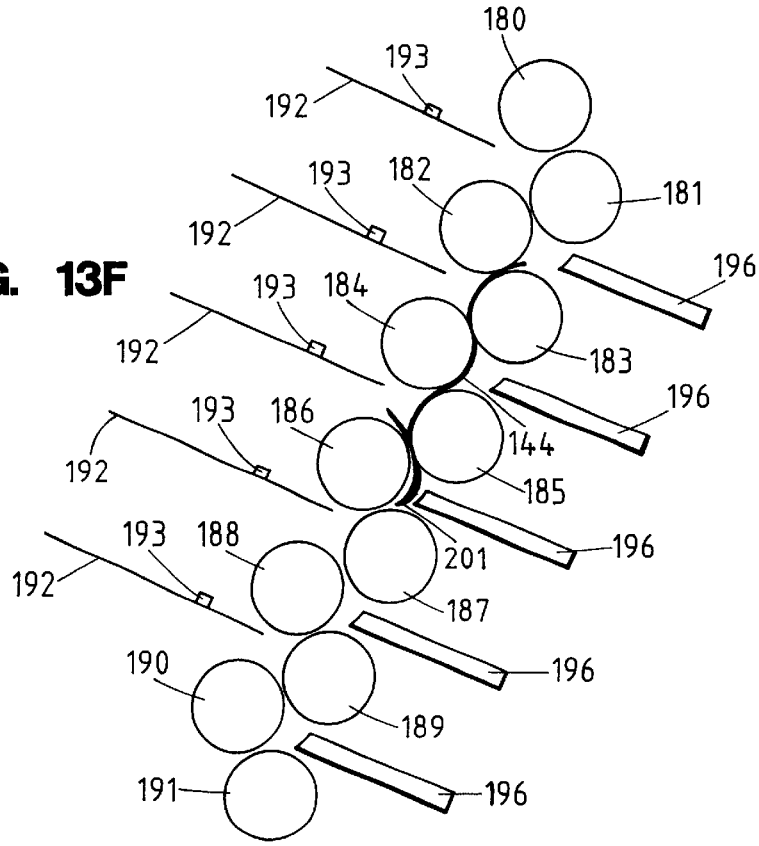
Figure 13G:
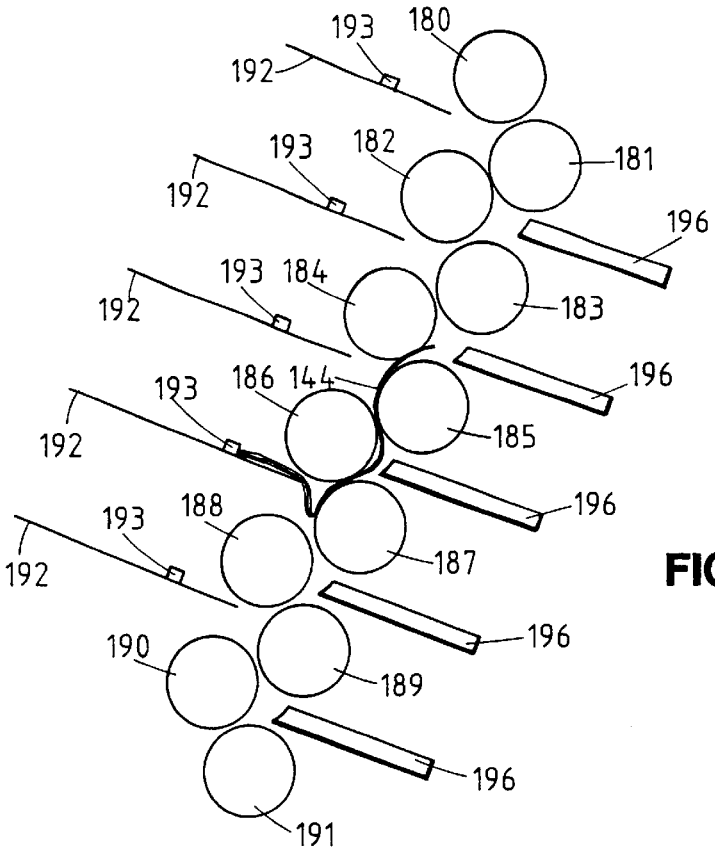
Figure 13H:
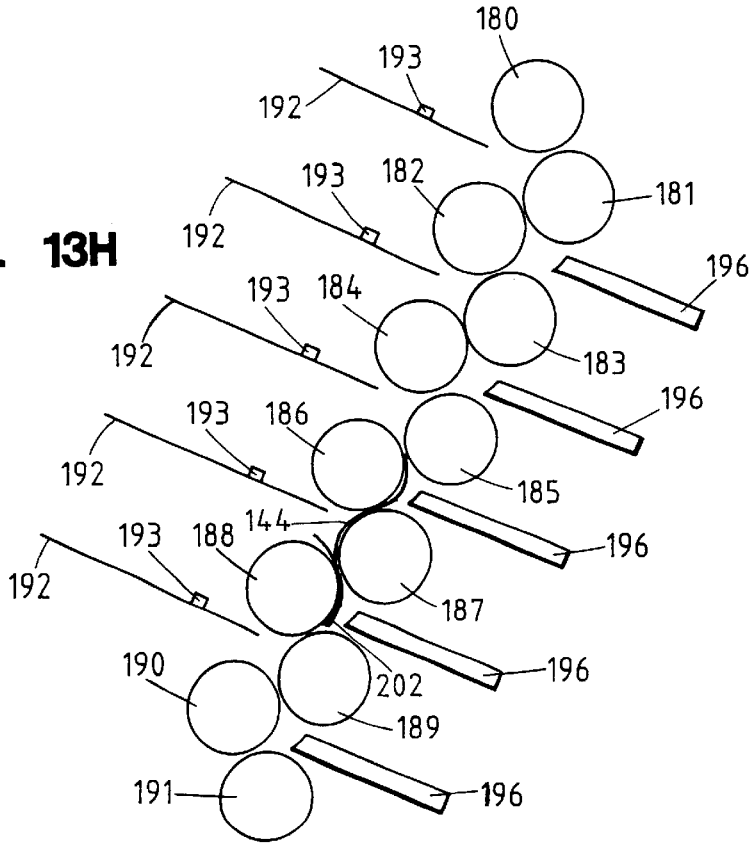
Figure 13I:
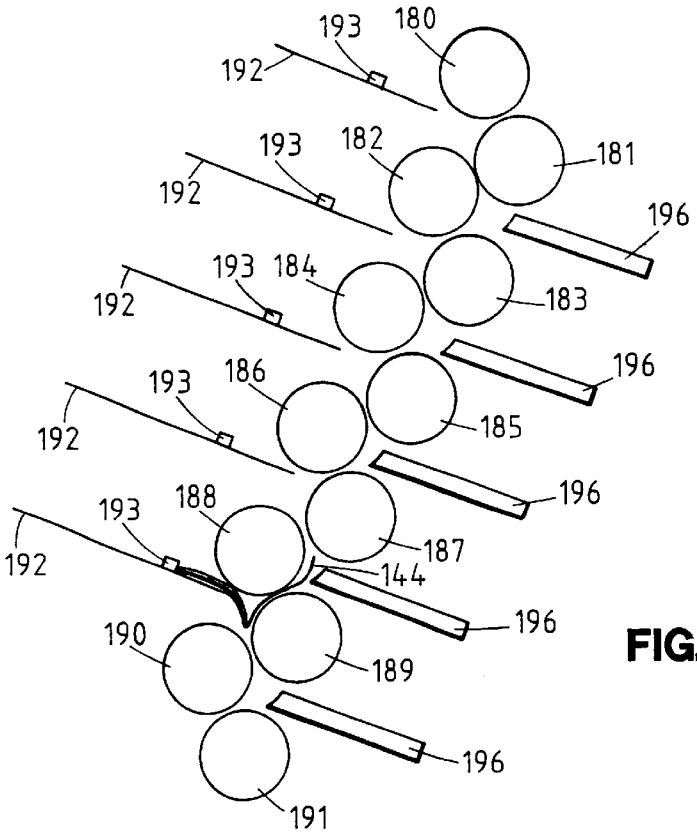
Figure 13J:
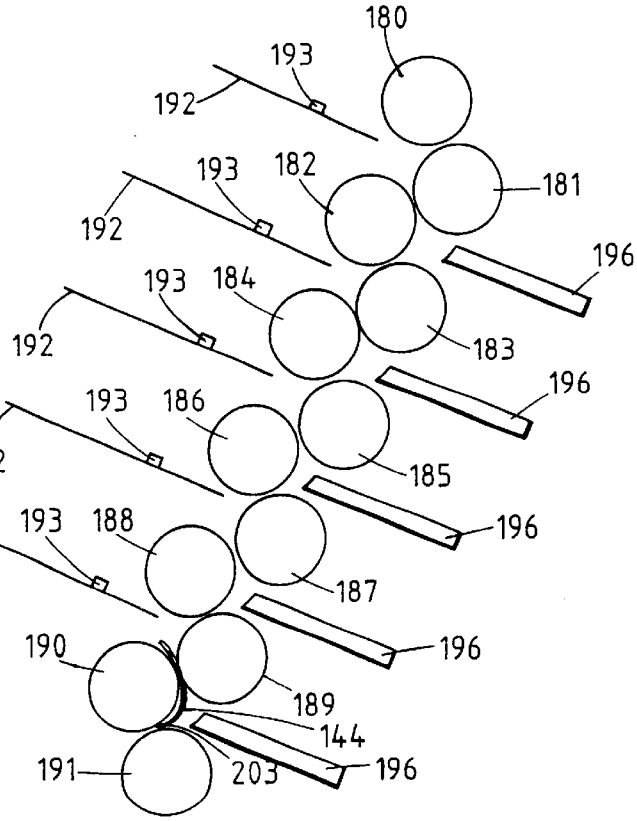
Figure 13K:
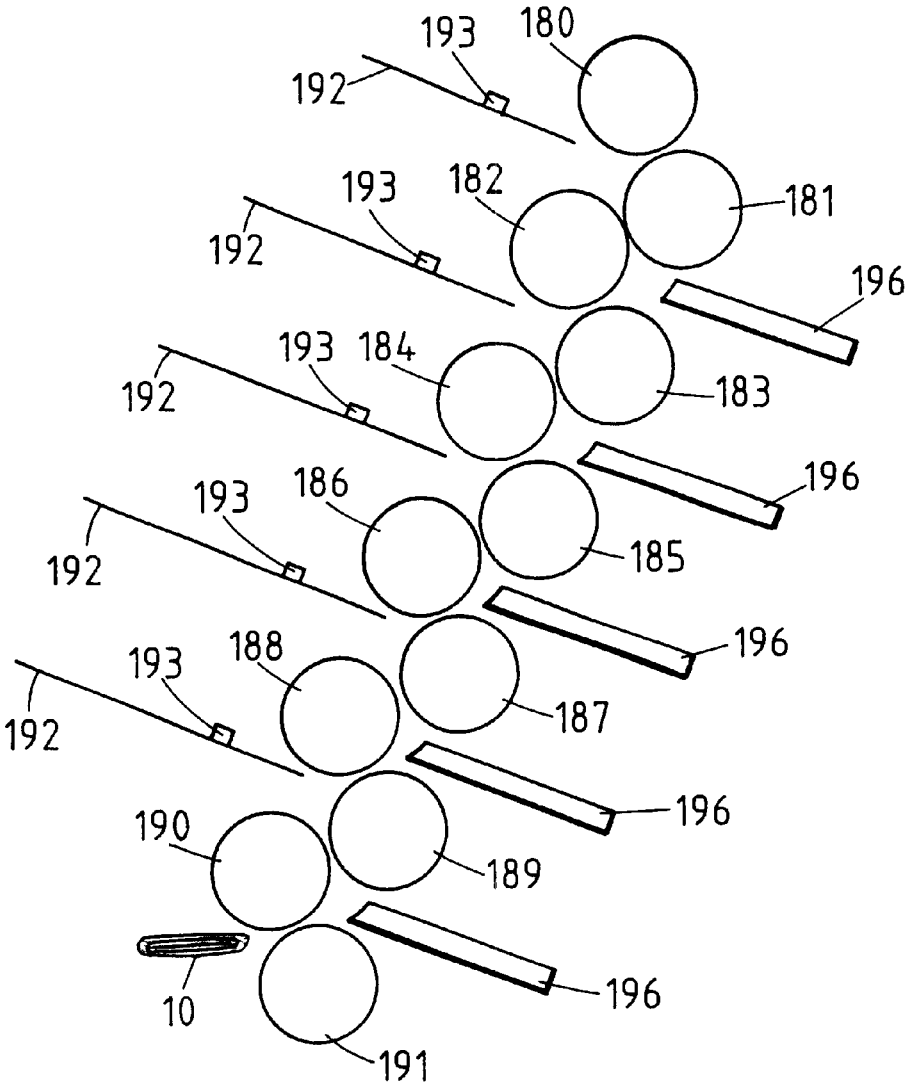
Figure 14:
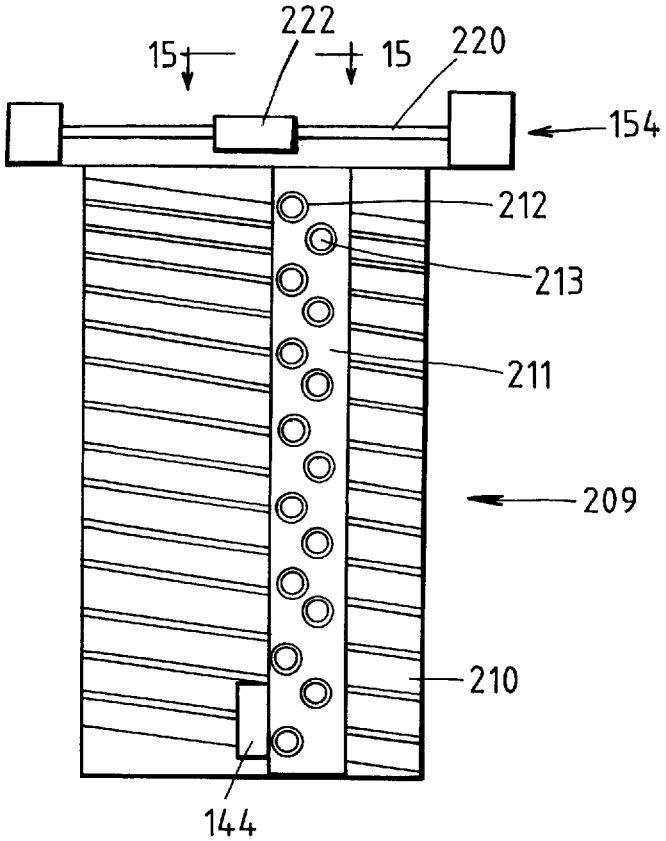
FIG. 14 is a plan view of an inlet conveyor used in the booklet forming apparatus.

Upon discharge from the first folding unit 153, the folded sheet 144 is discharged to a transfer conveyor 206 comprising upper and lower conveyor belts 207, 208 (FIG. 12). The upper and lower conveyor belts 207, 208 transfer the folded sheet 144 to an inlet conveyor 209 leading toward the slitter 154. As illustrated in FIG. 14, the inlet conveyor 209 comprises a plurality of rotatably driven rollers 210 for advancing the folded sheet 144. A sheet alignment mechanism is positioned directly over the rollers 210, and includes a retainer arm 211 having a plurality of cylindrical bores 212 formed therein. A respective metal ball 213 is disposed within each of the bores 212, and an L-shaped side guide (not shown) is connected to the retainer arm 211. The inlet conveyor 209 operates in a similar fashion to the conveyor 161 of the sheet feeder 151, in that the weight of the metal balls 213 maintains the alignment of the sheets relative to the rollers 210. The rollers 210 are angled slightly relative to the side guide and, consequently, the sheets are directed against the edge of the side guide to cause the side edge of the sheet to become justified (to the right in FIG. 14) against the side guide for proper alignment as the sheets enter the slitter 154.

Figure 15:
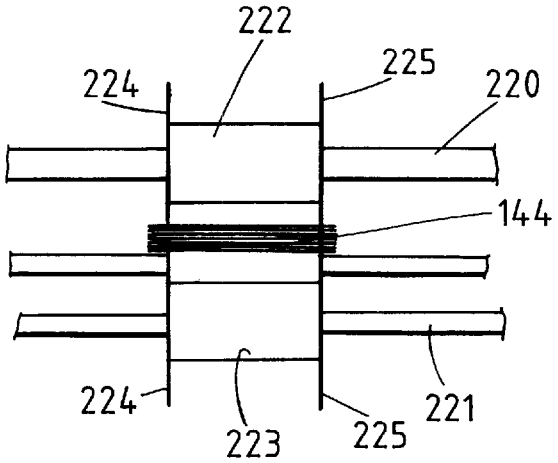
FIG. 15 is a diagrammatic end view of a slitter taken along line 15—15 of FIG. 14.

The slitter 154 is provided for cutting off lateral edges of the folded sheet 144. As illustrated in FIG. 15, the slitter 154 includes first and second rotatable shafts 220, 221, each shaft carrying a cutting element 222, 223. Each cutting element 222, 223 has first and second blades 224, 225 that cut off the lateral edges of the folded sheet as it passes. A receptacle (not shown) connected to a vacuum source (also not shown) is positioned to collect the removed lateral edges.

After passing the slitter 154, the folded and cut sheet 144 is conveyed to the closing folder 155. FIG. 16A illustrates the closing folder 155 shown schematically in FIG. 7. Referring to FIG. 16A, the closing folder 155 has four closing rollers 230, 231, 232, 233 arranged similarly to the folding rollers of the first folding unit 153. Accordingly, a leading edge of the folded and cut sheet 144 is fed between a first pair of vertically aligned closing rollers 230, 231 (FIG. 16A), which advance the folded and cut sheet across a downstream folding plate 234 until a leading edge engages a stop 235. The stop 235 forms a buckled portion 236 in the folded and cut sheet, as illustrated in FIG. 16A. The buckled portion 236 is gripped between a first pair of horizontally aligned closing rollers 231, 232 to form a final fold in the sheet. The stop 235 is positioned to form the final fold so that it is coincident with the linear path along which the adhesive was applied. As a result, the folded and cut sheet is folded in half to form the booklet 10. A deflector 237 located downstream of the first pair of horizontally aligned closing rollers directs the booklet, final fold first, through a second pair of vertically aligned closing rollers (FIG. 16C), which advance the booklet to an outlet conveyor 238 (FIG. 1CD). The conveyor may carry the booklet to an optional label applicator 156, schematically illustrated in FIG. 7. The label applicator 156 is conventionally known and is adapted to attach an adhesive-backed closure member about the unfolded side 16 of the booklet.

Figure 17:
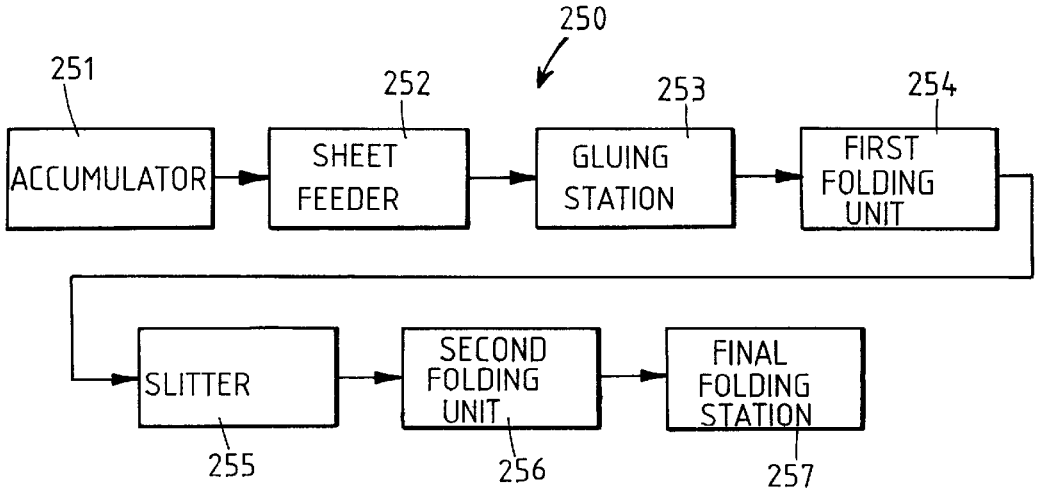
FIG. 17 is a block diagram of an alternative booklet folding apparatus which closes the booklet.

Alternatively, apparatus may be provided to form a right turn angle booklet, such as that illustrated in FIG. 6B. A block diagram of the apparatus 250 in which the present invention is incorporated is shown in FIG. 17. The apparatus 250 generally comprises an accumulator 251, a sheet feeder 252, a gluing station 253, a first folding unit 254, a slitter 255, a second folding unit 256, and a final folding station 257. The accumulator 251, sheet feeder 252, gluing station 253, first folding unit 254, and slitter 255 may be identical to those described above and, therefore, are not described in detail with reference to the current embodiment. The components downstream of the slitter 255 (i.e., the second folding unit 256 and final folding station 257), however, are different from the previous embodiment and are described more fully below.

Figure 18A:
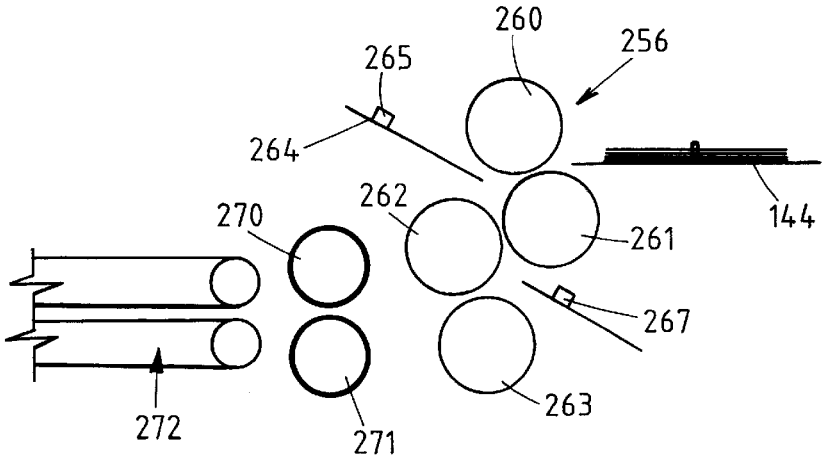
FIGS. 18A through 18E illustrate folding steps carried out by a second folding unit used in the alternative booklet folding apparatus of FIG. 17.
Figure 18B:
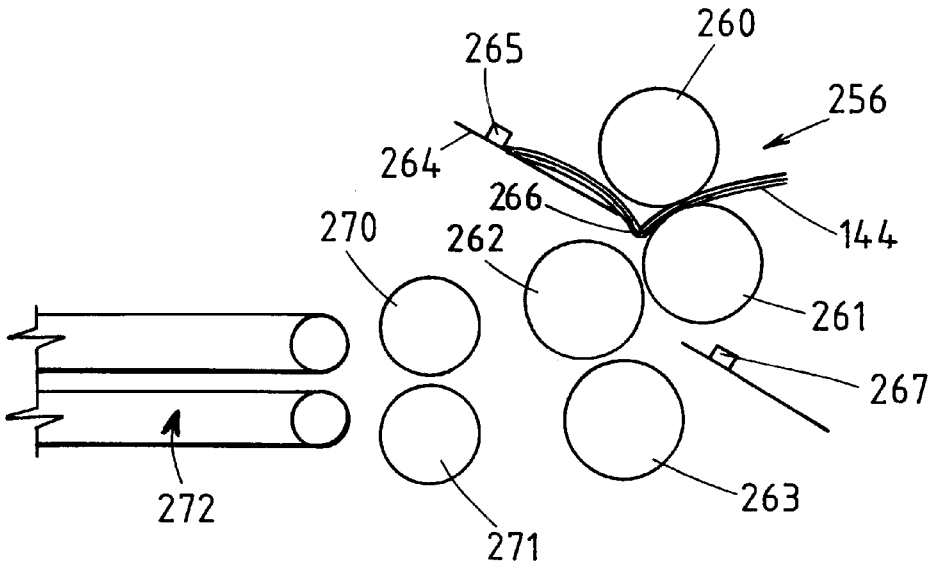
Figure 18C:
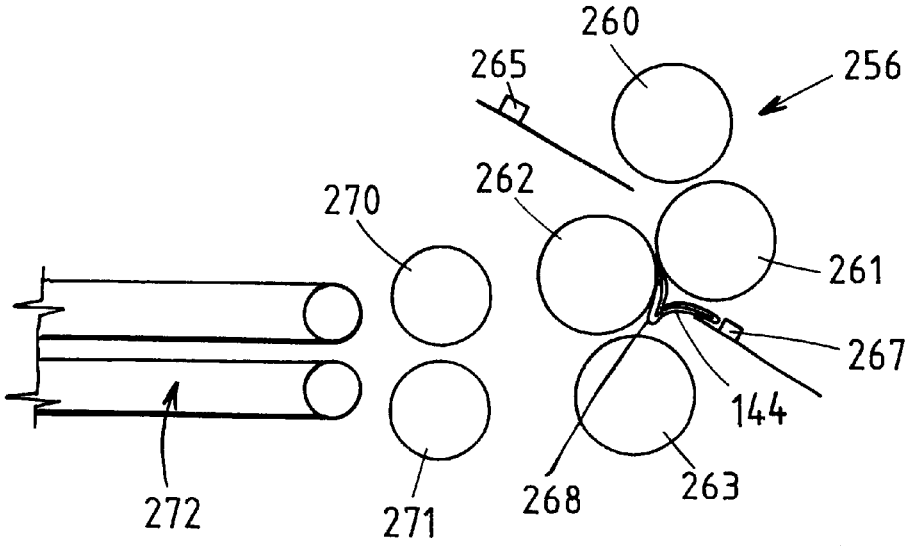
Figure 18D:
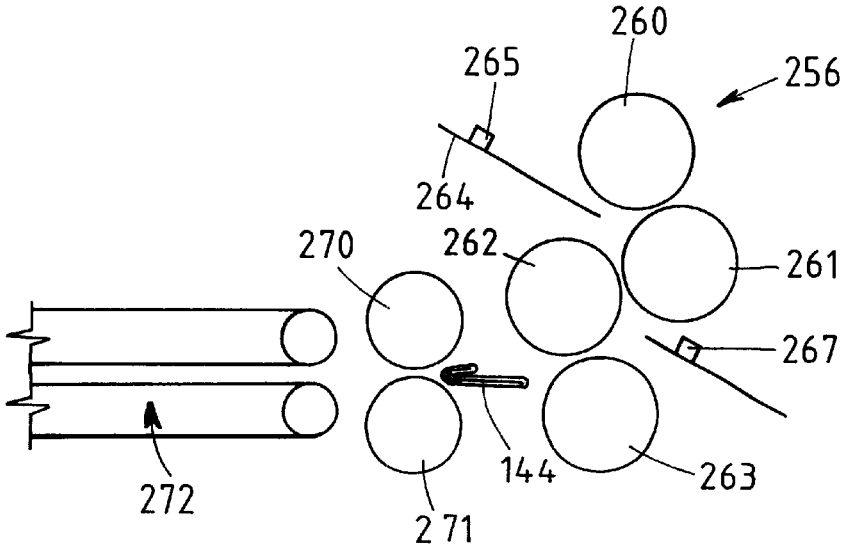
Figure 18E:
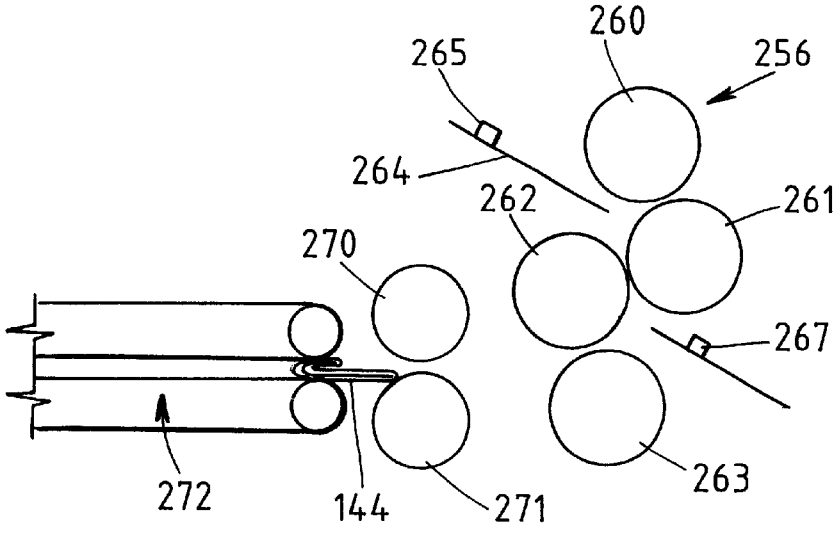

Folded and cut sheets advance from the slitter 255 to the second folding unit 256. FIG. 18A illustrates the second folding unit 256 shown schematically in FIG. 17. Referring to FIG. 18A, the second folding unit 256 includes four closing rollers 260, 261, 262, 263 arranged similarly to the folding rollers of the first folding unit 153. A leading edge of the folded and cut sheet 144 is fed between a first pair of vertically aligned closing rollers 260, 261 (FIG. 18A) which advance the folded and cut sheet across a downstream folding plate 264 until a leading edge engages a stop 265. The stop 265 forms a buckled portion 266 (FIG. 18B) which is gripped between a first pair of horizontally aligned closing rollers 261, 262 to form a final fold in the sheet. The stop 265 is positioned so that the final form is folded coincident with the linear path along which the adhesive was applied, the final fold thereby forming the booklet 10. The booklet is advanced across a second folding plate located downstream of the horizontal closing rollers 261, 262 until a leading edge engages a stop 267. The stop 267 is positioned to form a buckled portion 268 at approximately a trailing ⅓ portion of the booklet (FIG. 18C). The buckled portion 268 is gripped by a second pair of vertically aligned closing rollers 262, 263 to form a first close fold in the booklet (FIG. 18D). It will be appreciated that, in this embodiment, the first close fold is formed nearer the unfolded side 16 of the booklet. A pair of flattening rollers 270, 271 may be provided downstream of the second pair of vertically aligned closing rollers 262, 263 to compress the folded booklet 10 (FIG. 18E). The folded booklet 10 is then discharged to an outlet conveyor 272 which advances the booklet to the final fold station 257.

Figure 19A:
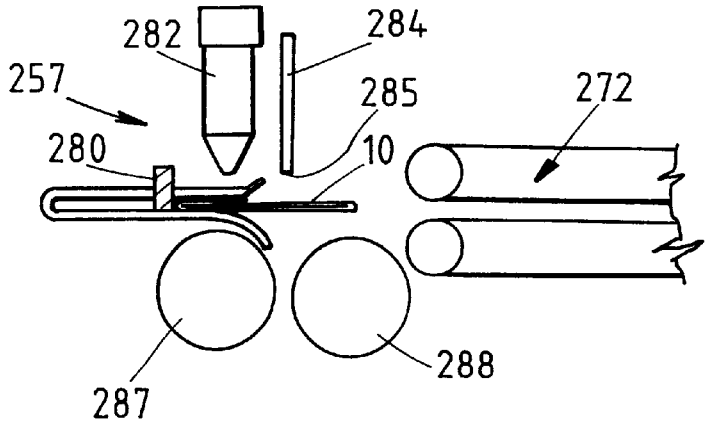
FIGS. 19A and 19B illustrate folding steps carried out by a final folding station used in the alternative booklet folding apparatus of FIG. 17.
Figure 19B:
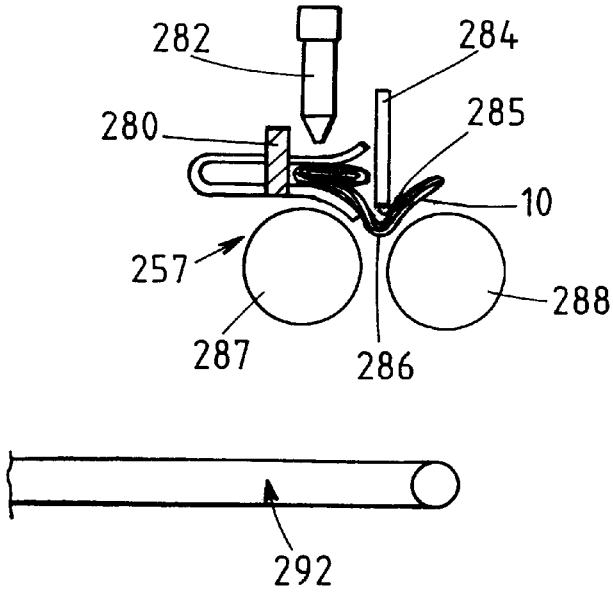

FIGS. 19A and 19B illustrate the final fold station 257 shown schematically in FIG. 17. Referring to FIG. 19A, the final fold station 257 has a paper stop 280 against which the outlet conveyor 272 discharges the folded booklet 10. An adhesive applicator 282 is located above the paper stop 280 and is positioned to deposit a drop of adhesive on a leading portion of the folded booklet 10. The adhesive applicator 282 may also be positioned above a trailing portion of the booklet in accordance with the present invention. After the drop of adhesive is applied, a knife folder 284, also positioned above the booklet 10, is brought into contact with a top surface of the booklet 10. The knife folder 284 has a serrated edge 285 to improve gripping characteristics. The knife folder 284 forms a buckled portion 286 in the folded booklet 10 at approximately ⅓ of the booklet length in from the folded side 14 (FIG. 19B). The buckled portion 286 is gripped by a pair of final folding rollers 287, 288 which form a second closing fold in the booklet. As the second closing fold is formed, the adhesive drops adhere a first portion 102 of the booklet 10 to a second portion 103 (as illustrated in FIG. 6B), thereby providing a closed, booklet style outsert. The closed booklet is deposited onto a final conveyor 292 (FIG. 19B) which carries the closed booklet to a stacker (not shown) for packaging.

In light of the above, it will be appreciated that the present invention brings to the art a new and improved method for forming a booklet outsert, and apparatus for forming the same. The booklet is formed from a single sheet of paper, thereby eliminating the need for aligning and binding different printed sheets. Adhesive is applied to the single sheet and the sheet is folded by making a plurality of folds parallel to a first direction, thereby forming an intermediate product having panels adhered to each other. Lateral edges of the intermediate product are cut off and the intermediate product is folded along the adhesive line to form a booklet. An unbound side of the booklet may be secured using an adhesive-backed closure member, or the booklet may be further folded and glued to form a compact, booklet style outsert. Apparatus is also provided for carrying out the method.

The foregoing detailed description has been given for clearness of understanding only, and no unnecessary limitations should be understood therefrom, as modifications would be obvious to those skilled in the art.

What is claimed:

1. A method of forming a closed booklet from a single sheet of paper, the booklet having a bound side, an unbound side parallel to the bound side, and two unbound sides perpendicular to the bound side, the method comprising the steps of:

applying an adhesive to the single sheet of paper along a linear path so that the adhesive makes contact with a plurality of rectangular sheet portions of the single sheet of paper;

folding the single sheet of paper by making a plurality of folds in the sheet of paper parallel to a first direction to form a plurality of sheet panels, each of the sheet panels corresponding to one of the rectangular sheet portions, each of the sheet panels being connected to at least one adjacent sheet panel, each of the sheet panels being separated from at least one adjacent sheet panel by one of the folds parallel to the first direction, each of the sheet panels being adhered to at least another of the sheet panels by the adhesive so that all of the sheet panels are adhered together to form an intermediate product having a first side, a second side, a third side, and a fourth side, the first and second sides being parallel to each other and parallel to the first direction;

making a plurality of cuts in the intermediate product so that the first side and the second side of the intermediate product are cut off and so that the sheet panels are no longer interconnected at the folds made in the first direction;

folding the intermediate product by making a final fold in the intermediate product along a line coincident with the linear path along which the adhesive was applied to form the booklet, the booklet so formed having a bound side coincident with the final fold, an unbound side spaced from the bound side and parallel to the final fold, and two unbound sides spaced from each other and perpendicular to the final fold;

folding the booklet by making a first closing fold in the booklet parallel to the linear path along which the adhesive was applied, the first closing fold being made so that the unbound side of the booklet parallel to the final fold is disposed between the bound side of the booklet and the first closing fold to form a partially closed booklet, the partially closed booklet so formed having a first portion between the first closing fold and the bound side of the booklet and a second portion between the first closing fold and the unbound side of the booklet; and folding the partially closed booklet by making a second closing fold in the first portion of the partially closed booklet parallel to the linear path along which the adhesive was applied, the second closing fold being made so that the first portion covers the unbound side of the booklet.

2. The method of claim 1, further comprising the step of depositing adhesive on the first portion of the booklet before making the second closing fold so that the booklet is held closed after the second closing fold is formed.

3. The method of claim 1, further comprising the step of attaching an adhesive label over the bound side of the booklet and the first closing fold to close the booklet.

4. The method of claim 1, in which each of the plurality of folds made during the sheet folding step is formed by folding a leading edge portion of the sheet against a first face of the sheet, the folds forming the sheet into a flat roll.

5. A method of forming a closed booklet from a single sheet of paper, the booklet having a bound side, an unbound side parallel to the bound side, and two unbound sides perpendicular to the bound side, the method comprising the steps of:

applying an adhesive to the single sheet of paper along a linear path so that the adhesive makes contact with a plurality of rectangular sheet portions of the single sheet of paper;

folding the single sheet of paper by making a plurality of folds in the sheet of paper parallel to a first direction to form a plurality of sheet panels, each of the plurality of folds being formed by folding a leading edge portion of the sheet against a first face of the sheet, the folds forming the sheet into a flat roll, each of the sheet panels corresponding to one of the rectangular sheet portions, each of the sheet panels being connected to at least one adjacent sheet panel, each of the sheet panels being separated from at least one adjacent sheet panel by one of the folds parallel to the first direction, each of the sheet panels being adhered to at least another of the sheet panels by the adhesive so that all of the sheet panels are adhered together to form an intermediate product having a first side, a second side, a third side, and a fourth side, the first and second sides being parallel to each other and parallel to the first direction;

making a plurality of cuts in the intermediate product so that the first side and the second side of the intermediate product are cut off and so that the sheet panels are no longer interconnected at the folds made in the first direction;

folding the intermediate product by making a final fold in the intermediate product along a line coincident with the linear path along which the adhesive was applied to form the booklet, the booklet so formed having a bound side coincident with the final fold, an unbound side spaced from the bound side and parallel to the final fold, and two unbound sides spaced from each other and perpendicular to the final fold;

folding the booklet by making a first closing fold in the booklet parallel to the linear path along which the adhesive was applied, the first closing fold being made so that the unbound side of the booklet parallel to the final fold is disposed between the bound side of the booklet and the first closing fold to form a partially closed booklet, the partially closed booklet so formed having a first portion between the first closing fold and the bound side of the booklet and a second portion between the first closing fold and the unbound side of the booklet; and folding the partially closed booklet by making a second closing fold in the first portion of the partially closed booklet parallel to the linear path along which the adhesive was applied, the second closing fold being made so that the fist portion covers the unbound side of the booklet.

6. The method of claim 5, further comprising the step of depositing adhesive on the first portion of the booklet before making the second closing fold so that the booklet is held closed after the second closing fold is formed.

7. The method of claim 5, further comprising the step of attaching an adhesive label over the bound side of the booklet and the first closing fold to close the booklet.

* * * * *